US006310277B1

(12) United States Patent
Shelley

(10) Patent No.: US 6,310,277 B1
(45) Date of Patent: Oct. 30, 2001

(54) TONAL CYMBAL

(75) Inventor: Thomas W. Shelley, Struther, OH (US)

(73) Assignee: Universal Percussion, Inc., Columbiana, OH (US)

( * ) Notice: Subject to any disclaimer, the term of this patent is extended or adjusted under 35 U.S.C. 154(b) by 0 days.

(21) Appl. No.: 09/478,419

(22) Filed: Jan. 6, 2000

Related U.S. Application Data

(63) Continuation-in-part of application No. 09/239,212, filed on Jan. 28, 1999, now Pat. No. 6,034,313.

(60) Provisional application No. 60/132,148, filed on May 3, 1999.

(51) Int. Cl.[7] ..... G10G 7/00

(52) U.S. Cl. ..... 84/422.3; 84/422.1; 84/422.2; 84/402; 84/403

(58) Field of Search ..... 84/422.1, 422.2, 84/422.3, 403, 404, 402; D17/99

(56) References Cited

U.S. PATENT DOCUMENTS

| | | | | |
|---|---|---|---|---|
| D. 21,953 | * | 11/1892 | Hull | 84/4 |
| D. 263,480 | * | 3/1982 | Cohen | D17/4 |
| D. 297,015 | * | 8/1988 | Hargrove | D17/22 |
| D. 301,893 | | 6/1989 | Hargrove . | |
| 2,559,143 | | 7/1951 | Zildjian . | |
| 3,453,923 | | 7/1969 | Paiste . | |
| 3,546,994 | | 12/1970 | Paiste . | |
| 3,592,097 | | 7/1971 | Friede . | |
| 3,640,029 | | 2/1972 | Zildjian . | |
| 3,677,127 | | 7/1972 | Garven . | |
| 4,114,502 | | 9/1978 | Zildjian . | |
| 4,248,129 | | 2/1981 | Zildjian . | |
| 4,320,687 | | 3/1982 | Kidwell . | |
| 4,677,892 | | 7/1987 | Kramer et al. . | |
| 4,718,964 | | 1/1988 | Sawada et al. . | |
| 4,787,876 | | 11/1988 | Nguyen et al. . | |
| 4,807,510 | | 2/1989 | Croteau . | |
| 4,809,581 | | 3/1989 | Paiste, Sr. et al. . | |
| 4,843,944 | * | 7/1989 | Shimoda | 84/418 |
| 4,911,056 | | 3/1990 | Belli et al. . | |
| 5,266,733 | | 11/1993 | Jacobson . | |
| 5,367,939 | | 11/1994 | Barker . | |
| 5,639,976 | | 6/1997 | Manoff et al. . | |
| 5,856,628 | * | 1/1999 | Noguchi et al. | 84/738 |
| 6,034,313 | * | 3/2000 | Shelley | 84/422.3 |

OTHER PUBLICATIONS

The Woodwind and Brasswind Mater Catalog 1999–2000, p. 296 and p. 436.*

* cited by examiner

*Primary Examiner*—Robert E. Nappi
*Assistant Examiner*—Kim Lockett
(74) *Attorney, Agent, or Firm*—Vickers, Daniels & Young

(57) ABSTRACT

A cymbal made of a sound producing a plate which includes a plurality of linear ribs to enhance the strength of the cymbal and to provide a unique sounding cymbal. The ribs are positioned on the top and/or bottom surface of the cymbal. The ribs extend substantially from the center of the cymbal and/or from a point spaced from the center of the cymbal. The ribs extend substantially to the edge of the cymbal and/or extend to a point which is spaced from the edge of the cymbal.

52 Claims, 5 Drawing Sheets

TONAL CYMBAL

IMPROVED TONAL CYMBAL

The present invention is a continuation-in-part of co-pending U.S. patent application Ser. No. 09/239,212 filed Jan. 28, 1999 now U.S. Pat. No. 6,034,313, titled Improved Tonal Cymbal. The present invention also claims priority on co-pending U.S. Provisional Patent Application No. 60/132,148 filed May 3, 1999 titled Tonal Cymbal. The invention pertains to the art of musical instruments and more particularly to cymbals. The invention specifically pertains to a modified cymbal that includes a unique design to produce a richer and fuller sounds when the cymbal is struck and to resist damage during play.

INCORPORATION BY REFERENCE

U.S. Letters Pat. Nos. D297,015; 4,114,502; 4,807,510; and 4,911,056; U.S. patent application Ser. No. 09/239,212 filed Jan. 28, 1999 and U.S. Provisional Patent Application No. 60/132,148 filed May 3, 1999 are incorporated herein by reference.

BACKGROUND OF THE INVENTION

A conventional cymbal comprised as a concave circular disc or plate, usually made of brass or bronze. The tone of high quality cymbals contain a blend of virtually all the notes of the scale or their harmonic compliments, made up of a fundamental tone or bell tone, and overtones. Cymbals can vary from one another quite distinctly in tone. Cymbals of a seeming identity may have a distinct tone, according to its unique dominate pitch in response to sympathetic vibration. The usual sound affect desired from a cymbal is a "crash."

Cymbals are made in various categories according to variations in size, weight, surface curvature, the latter variation including various tapers, surface curvature varying from a substantially uniform or flat topped curvatures to those having a central cup or bell, which is of a shorter radius in the remainder or bow of the cymbal and raised above it. Cymbals are also made especially for different uses, such as those played singly, and paired cymbals which are struck together, hand-held or by foot petal stand. Various attempts have been made to produce a cymbal having an improved sound. Such cymbals are disclosed is U.S. Letters Pat. Nos. D301,893; D297,015; 4,320,687; 4,114,502; and 4,807,510. U.S. Letters Pat. No. D297,015 discloses an octagon shaped cymbal having a smooth surface. U.S. Letters Pat. No. D301,893 discloses a circular cymbal having pitted regions randomly dispersed throughout the top of the cymbal. U.S. Letters Pat. No. 4,114,502 discloses a cymbal have multiple mounting apertures at the top of the cymbal. U.S. Letters Pat. No. 4,320,687 discloses an elliptical cymbal.

Cymbals have been designed to include circular tonal grooves. These tonal grooves are in the shape of circular arcs which increase in diameter from the center of the cymbal. Score lines have also been added to cymbals. Score lines are non-uniform grooves that extend from the top to the edge of the cymbal. The score lines have varying widths and depths, are not uniformly spaced from one another, and are limited to a small region on the cymbal. Typically 1–5 score lines are contained in a small region on the cymbal. These cymbals generally 1 to 3 regions of score lines, which are separated from one another on the cymbal.

Cymbals have also been designed to be used as crash cymbals. These cymbals are typically struck with a drum stick with a large force to produce a "crash" sound. Typically these cymbals are made from a thin material to enhance to the amount of vibration and sound generated when the cymbal is struck. However, these cymbals have a tendency to crack or shatter after periods of short use. This can become very inconvenient if the cymbal cracks or breaks during a song or concert.

SUMMARY OF THE INVENTION

The invention pertains to the art of musical instruments and more particularly to musical instruments that are struck to produce a sound. The invention specifically pertains to cymbals that have been modified to include a unique design which produces a richer and fuller sounds when struck, and which resist damage during play and will be described with particular reference thereto; however, the invention has broader applications and can be used in other percussion instruments such as bells, chimes and the like.

The invention is applicable to all cymbals of all categories, but more particularly cymbals played individually and which are provided with a central aperture to receive a pin on a support stand to suspend the cymbal for playing. The support stand is usually provided with an adjustable top by which the suspension of the cymbal may be varied from horizontal to various angles thereto to suit the convenience of the player.

The improved cymbal includes a unique design that produces a rich sound when struck, and which resists damage when struck by a large force. The advantages of the improved cymbal are obtained by including a plurality of ribs or ridges on the surface of the cymbal. The ribs are designed to enhance the strength and/or rigidity of the cymbal so as to resist being cracked or shattered during play. The ribs are be of any desired shape and/or size. The number, size and shape of the ribs affects the type and amount of sound produced by the cymbal. The more ribs included on the cymbal, the more rigid the cymbal. The more rigid cymbal has enhanced resistance to damage; however, the cymbal may produced a reduced "crash" type sound. The ribs are generally 0.001 to 0.5 inch thick (i.e. height); however, other thicknesses can be used. In one preferred embodiment, all the ribs on the cymbal are the same shape and size. In another preferred embodiment, at least one rib on the cymbal has a different shape and/or size from another ribs. In one specific embodiment, at least a majority of the ribs are substantially linear in shape. In another specific embodiment, at least a majority of the ribs have a generally arcuate shape that is generally uniform along the longitudinal length of the rib.

In accordance with another aspect of the present invention, the cymbal includes a plurality of ribs that extend from the top of the cymbal toward the edge of the cymbal. In one preferred embodiment, at least one rib extends to the edge of the edge of the cymbal. In one specific embodiment, at least a majority of the ribs extend to the edge of the cymbal. In another preferred embodiment, none of the ribs extend to the edge of the cymbal. In still another preferred embodiment, at least one ribs extends to the top center of the cymbal. In still yet another preferred embodiment, non of the ribs extend to the top center of the cymbal. In on e s pecific embodiment, at least a majority of the ribs extend to the bell of the cymbal, which bell is position about the top center of the cymbal.

In accordance with still another aspect of the present invention, the cymbal includes a plurality of ribs positioned on the top and/or bottom surface of the cymbal. In one preferred embodiment, at least a majority of the ribs are positioned on the top surface of the cymbal. In another preferred embodiment, at least a majority of the ribs are positioned on the bottom side of the cymbal. In still another embodiment, the number of ribs on the top and bottom side of the cymbal are the same.

In accordance with yet another aspect of the present invention, the cymbal includes a plurality of ribs that are substantially symmetrically positioned about the surface of the cymbal. The symmetrical positioning of the ribs enhances the uniformity of sound generated by the cymbal when struck. The symmetrical positioning of the ribs also maximizes the strength and rigidity of the cymbal as a function of the number of ribs used in the cymbal.

In accordance with still yet another aspect of the present invention, the cymbal the ribs are formed by stamping and/or molding techniques. The stamping process forms a rib on one surface of the cymbal and a complimentary groove on the other surface. The molding process can form the same type of rib or a rib on one surface and a non-complimentary shape on the other surface.

In accordance with a further aspect of the present invention, the cymbal has an other shape that is a function of the number of ribs incorporated of the cymbal. A cymbal having two ribs has a generally circular or elliptical shape. A cymbal having three ribs has three outer edges forming a generally triangular shape. A cymbal having four ribs has four outer edges forming a generally square shape. A cymbal having five ribs has five outer edges forming a generally pentagon shape. A cymbal having six ribs has six outer edges forming a generally hexagon shape; and etc. In one preferred embodiment, the cymbal has three to ten ribs. In one specific embodiment, the cymbal has five ribs that forms five outer edges forming a generally pentagon shape.

In accordance with a firther aspect of the present invention, the cymbal includes the use of at least one tonal groove to produce a rich and vibrant sound. The tonal grooves are designed to extend from the center and/or close to the center of the cymbal to the edge and/or close to the edge of the cymbal. The tonal groove may be linear and/or arcuate shaped.

In accordance with yet a further aspect of the invention, the cymbal can be made up of a variety of materials such as plastic, metal, fiberglass, etc. In one embodiment, the cymbal is made up of copper and/or brass. In another embodiment, the shape of the cymbal is circular; however, other shapes of the cymbal may be used such as elliptical, polygonal, etc. The curvature of the cymbal may also be varied to produce a variety of different sounds. The curvature may range from a substantially flat to a substantially curved surface cymbal. In still another embodiment, the cymbal includes at least one aperture to receive a pin on a supporting stand to suspend the cymbal for playing. Preferably, one aperture is position substantially at the center of the cymbal. Other apertures can be incorporated in the cymbal to mount the cymbal non-symmetrically on a stand.

In accordance with another aspect of the present invention, the cymbal can have varying thickness to produce different sounds when different regions of the cymbal are struck. The thickness of the cymbal may be designed to uniformly vary or randomly vary. The thickness of the cymbal can varied by changing the thickness of the metal at the top and/or bottom of the cymbal.

In accordance with yet another aspect of the invention, the cymbal includes circular ribs extending at least partially about the center of the cymbal. The ribs can be symmetrically and/or non-symmetrically positioned about the center of the cymbal. Each rib can have a uniform or non-uniform height and/or width. In addition, the height and/or width of the ribs may be coordinated to produce a particular tonal sound or random. The one or more ribs can be positioned on the top and/or bottom of the cymbal. In one embodiment, the thickness of the ribs is at least about 0.005", preferably about 0.01–0.5", and more preferably 0.01–0.1". As can be appreciated, other dimensions can be used to obtained the desired sound from the cymbal.

In accordance with yet another aspect of the present invention, the tonal grooves extend from or near the center of the cymbal towards the edge of the cymbal. In one preferred embodiment, the tonal grooves extend from at or near the center of the cymbal to substantially the edge of the cymbal. In another preferred embodiment, the tonal grooves extend from at or near the center of the cymbal to a positioned spaced from the edge of the cymbal. In such a spaced relationship, the spacing from the edge of the cymbal is at least about 0.25", and preferably about 0.5–3", and more preferably about 0.5–1". As can be appreciated, other dimensions can be used to obtained the desired sound from the cymbal. In one specific embodiment, the spacing of all the tonal grooves from the edge of the cymbal is substantially uniform. In another specific embodiment, the spacing of one or more of the tonal grooves from the edge of the cymbal is non-uniform. In yet another preferred embodiment, one or more tonal grooves extend from at or near the center of the cymbal to a positioned spaced from the edge of the cymbal. In such a design, the length of the tonal grooves is not uniform on the cymbal. In still another preferred embodiment, the length of the tonal grooves is varied to obtain a desired tone and richness of sound for the cymbal.

In accordance with another aspect of the present invention, the tonal grooves are positioned on the cymbal so as to extend to or near the center of the cymbal. In one preferred embodiment, the tonal grooves all extend substantially from the center of the cymbal. In another preferred embodiment, the tonal grooves extend from a positioned spaced from the center of the cymbal. In such a spaced relationship, the spacing from the center of the cymbal is at least about 0.25", and preferably about 0.5–3", and more preferably about 0.5–1". As can be appreciated, other dimensions can be used to obtained the desired sound from the cymbal. In one specific embodiment, the spacing of all the tonal grooves from the center of the cymbal is substantially uniform. In another specific embodiment, the spacing of one or more of the tonal grooves from the center of the cymbal is nonuniform. In yet another preferred embodiment, one or more tonal grooves extend substantially from the center of the cymbal, and one or more tonal grooves extend from a position spaced from the center of the cymbal. In such a design, the length of the tonal grooves is not uniform on the cymbal. In still another preferred embodiment, the length of the tonal grooves is varied to obtain a desired tone and richness of sound for the cymbal.

In accordance with still yet another aspect of the present invention, the length of the tonal grooves on the cymbal is substantially uniform. In one preferred embodiment, the length of the tonal grooves is substantially uniform on the top side of the cymbal. In another preferred embodiment, the length of the tonal grooves is substantially uniform on the bottom side of the cymbal. In still another preferred embodiment, the length of the tonal grooves is substantially uniform on the top and bottom side of the cymbal.

In accordance with yet another aspect of the present invention, the tone quality produced from the tonal grooves is controlled by varying the depth of the grooves. The depth of the grooves may be uniform or may be varied along the length of the tonal groove. In addition, the cymbal may be designed so that one or more tonal grooves has a different groove depth than other tonal grooves on the cymbal. In one preferred embodiment, the depth of the tonal grooves are substantially uniform. In another preferred embodiment, the depth of one of more tonal grooves is different from other tonal grooves. In yet another preferred embodiment, the depth of the tonal grooves at substantially uniform on at least one side of the cymbal. Preferably, the depth of the tonal grooves is at least about 0.001", preferably about 0.005–0.1", and more preferably about 0.005–0.05". As can be appreciated, other dimensions can be used to obtained the desired sound from the cymbal.

In accordance with another aspect of the present invention, the tone quality produced from the tonal grooves is controlled by varying the width of the grooves. The width of the grooves may be uniform or may be varied along the length of the tonal groove. In addition, the cymbal may be designed so that one or more tonal grooves has a different groove width than other tonal grooves on the cymbal. In one preferred embodiment, the width of the tonal grooves are substantially uniform. In another preferred embodiment, the width of one of more tonal grooves is different from other tonal grooves. In yet another preferred embodiment, the width of the tonal grooves at substantially uniform on at least one side of the cymbal. Preferably, the width of the tonal grooves is at least about 0.001", preferably about 0.005–0.1", and more preferably about 0.005–0.05". As can be appreciated, other dimensions can be used to obtained the desired sound from the cymbal.

In accordance with still another aspect of the present invention, the tonal grooves are selectively positioned on the bottom and/or top side of the cymbal to achieve the desire tonal quality of the cymbal. In one preferred embodiment, the tonal grooves are positioned only on the bottom side of the cymbal. In another preferred embodiment, the tonal grooves are positioned only on the top side of the cymbal. In still another preferred embodiment of the invention, the tonal grooves are positioned on the top and bottom sides of the cymbal.

In accordance with still yet another aspect of the present invention, the spacing of the grooves from one another is substantially uniform. In one specific embodiment, the tonal grooves are substantially symmetrically oriented on one side of the cymbal. In another specific embodiment, the tonal grooves are substantially symmetrically oriented on both sides of the cymbal. In another embodiment of the present invention, the spacing of a plurality of tonal grooves varies from one another. In one specific embodiment, the tonal grooves are non-symmetrically oriented on one side of the cymbal. In another specific embodiment, the tonal grooves are non-symmetrically oriented on both sides of the cymbal.

In accordance with yet another aspect of the present invention, the tonal grooves extending from at or near the center of the cymbal to at or near the edge of the cymbal are used in combination with other tonal altering modifiers to the cymbal, such as circular tonal grooves, pitted surfaces, score lines, chemical surface treatments (i.e. etching) and coatings (i.e plastic or polymer coating), and the like. In one preferred embodiment, the tonal grooves extending from at or near the center of the cymbal to at or near the edge of the cymbal are positioned on the same side of the cymbal which include one or more other tonal altering cymbal modifiers. In another preferred embodiment, the tonal grooves extending from at or near the center of the cymbal to at or near the edge of the cymbal are positioned on a different side of the cymbal which include one or more other tonal altering cymbal modifiers.

It is accordingly a principal object of the present invention to provide musical instrument with richer and faller sounds.

Another object of the present invention is the provision of a musical instrument having a increased strength and/or rigidity to resist cracking or shattering during play.

Still another object of the present invention is the provision of a musical instrument having a plurality of ribs or ridges.

Still yet another object of the present invention is the provision of a musical instrument having a plurality of ribs symmetrically oriented about the surface of the musical instrument.

A further object of the present invention is the provision of a musical instrument having a plurality of ribs extending from the top of the cymbal to at least closely adjacent to the edge of the musical instrument.

Still a further object of the present invention is the provision of a musical instrument having a plurality of ribs having substantially the same shape and size.

Still yet a further object of the present invention is the provision of a musical instrument having a plurality of ribs positioned on one or both sides of the musical instrument.

Yet another object of the present invention is the provision of a musical instrument having two or more outer edges.

Another object of the present invention is the provision of a musical instrument having a plurality of tonal grooves.

Still another object of the present invention is the provision of a musical instrument having substantially straight tonal grooves.

Yet another object of the present invention is the provision of a musical instrument having tonal grooves that forma particular depending on the width, depth, orientation and/or number of tonal grooves.

Still yet another object of the present invention is the provision of a musical instrument having tonal grooves on one or more sides of the musical instrument.

Another object of the present invention is the provision of a musical instrument that has symmetrically oriented tonal grooves.

Yet another object of the present invention is the provision of a musical instrument that has tonal grooves with a substantially uniform length.

Still another object of the present invention is the provision of a cymbal having a plurality of tonal grooves extending substantially linearly from and/or near the center of the cymbal to at and/or near the edge of the cymbal.

Still yet another object of the present invention is the provision of a cymbal having a variety of shapes, sizes and/or thicknesses.

Yet a further object of the present invention is the provision of a cymbal having one or more mounting apertures.

Yet another object of the present invention is the provision of a cymbal having substantially linearly shaped tonal grooves and another tone modifier on the cymbal such as circular tonal grooves, pitted surfaces, score lines, chemical surface treatments or coatings, and the like.

These and other objects and advantages will become apparent from the following description used to illustrate the preferred embodiment of the invention when read in conjunction with the accompanying drawings.

DESCRIPTION OF THE PREFERRED EMBODIMENTS

Figure 1:
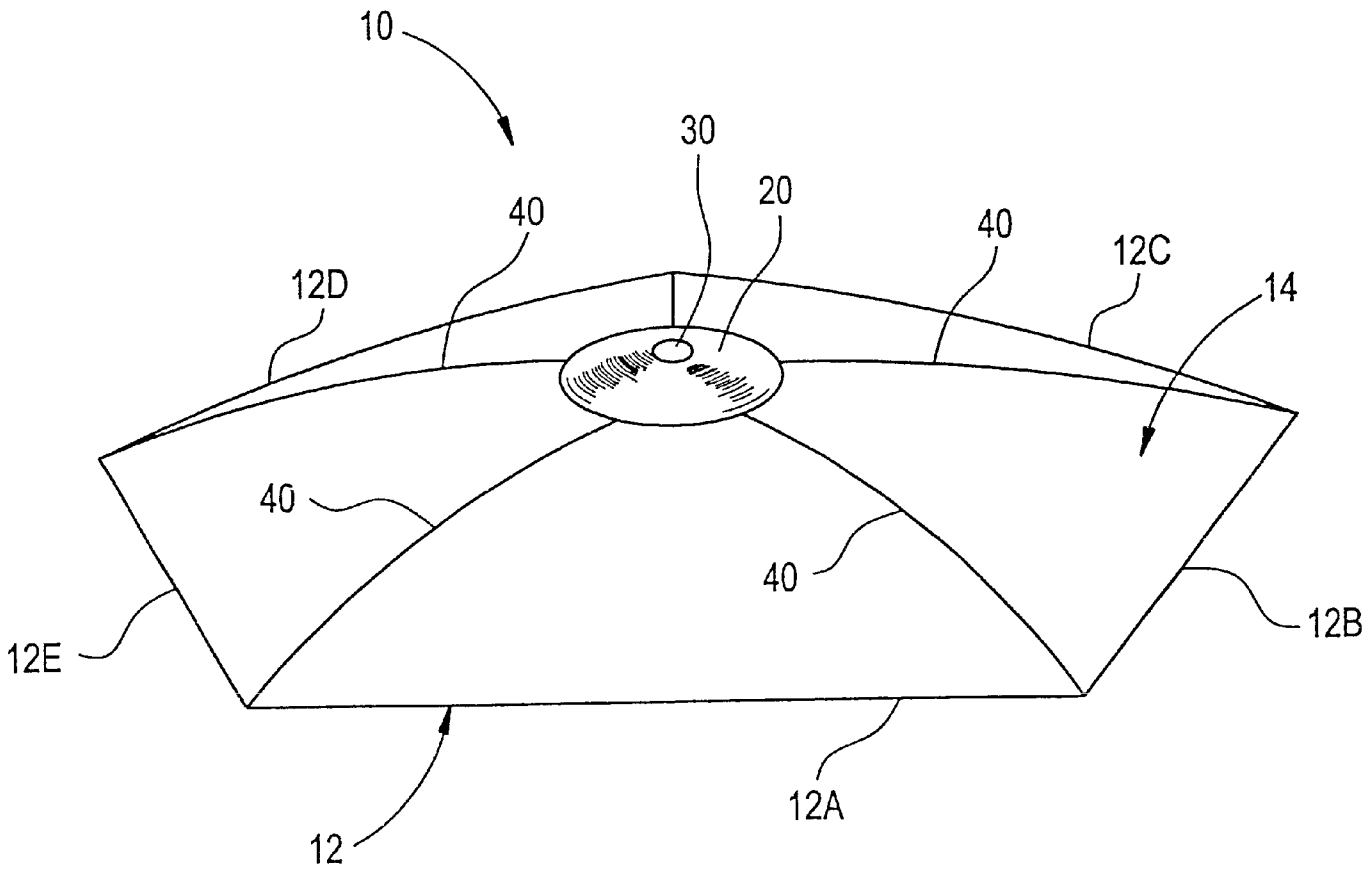
FIG. 1 is a top elevation view of the cymbal having a plurality of ribs spaced from the center of the cymbal and extending to the edge of the cymbal in accordance with the present invention.

Referring now to the preferred embodiment of the drawings, wherein the showings are for the purpose of illustrating a preferred embodiment of the invention only and not for the purpose of limiting the invention, FIG. 1 is schematic drawing of a cymbal 10. The cymbal is of the conventional flat topped type and size (7–36 in. diameter) which is generally concavo-convex. The cymbal is made of a resilient material such as copper, bronze, brass, copper alloys, steel, and the like. Preferably the material produces a sustained crash sound when struck by a drum stick, mallet, brush, or other striking device. Cymbal 10 has a peripheral edge 12 made or five sides 12A–E. The five sided cymbal has a generally pentagon shape as seen from the top of the cymbal. In the central portion of the cymbal, this is a circular bell 20 that includes an opening 30. Opening 30 provides a means to mount the cymbal in suspension. Opening 30 is positioned substantially in the center of the bell; however, the opening can be positioned in other locations on the cymbal. Typically cymbal 10 is mounted on a stand so as to be in generally free suspension. The cymbal may be attached to the stand by a threaded cap or the like. This form of mounting, and the alternates thereof, are well known in the art and no further details will be described. Alternatively, opening 30 is used to secure handles to the cymbals for handheld playing of the cymbal. The size and configuration of bell 30 is dependant or the particular sound and use of the cymbal. As can be appreciated, the cymbal can be formed without a bell if desired.

Figure 6:
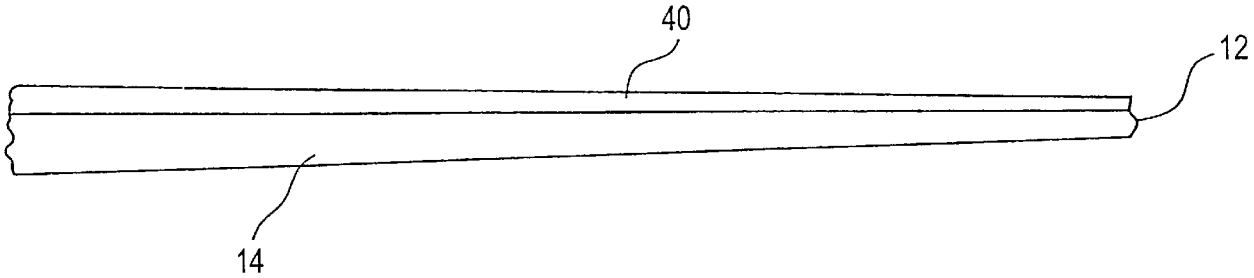
FIG. 6 is a partial cross-sectional view of a cymbal showing a rib having a varying height alone the length of the rib.
Figure 7:
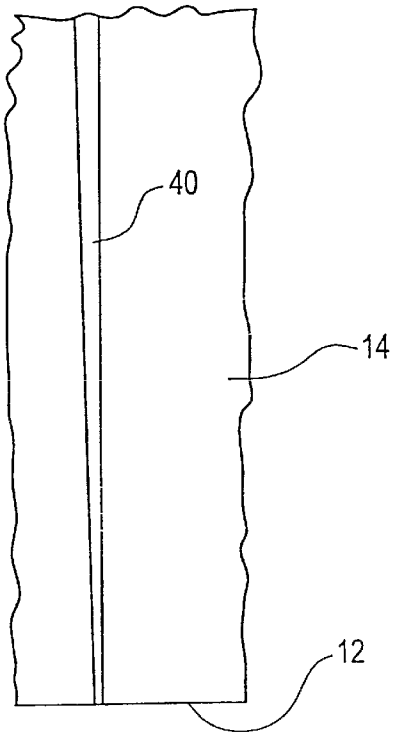
FIG. 7 is a partial sectional view of the top of a cymbal showing a rib having a varying width alone the length of the rib.

Cymbal 10 is shown as including a plurality of ribs 40. As shown in FIG. 1, the ribs 40 extend from bell 30 toward the peripheral edge 12 of cymbal 10. The ribs are generally arcuate shaped ridges that radiate along the radius of the cymbal. The ribs are substantially linear and extend essentially along the radius of the cymbal. The ribs are substantially symmetrically spaced apart from one another. In such a configuration, the spacing between adjacent ribs is substantially the same at a particular point along the radial axis of the cymbal. The ribs are positioned on the cymbal such that as the ribs extend toward the peripheral edge 12 of the cymbal, the spacing between adjacent ribs increases. Consequently, the spacing between adjacent ribs is the smallest near the center of the cymbal and largest at or near the peripheral edge of the cymbal. The ribs preferably have a constant width and height along the length of the rib; however, the height and width of the rib can be varied to further change the tonal sound of the cymbal in different regions on the cymbal. As shown in FIG. 6, the height of the rib 40 varies along the length of the rib 40. In FIG. 7, the width of rib 40 is shown to vary alone the length of the rib. Cymbal 10 includes five ribs on the top surface 14 of the cymbal.

The ribs are general formed by an automated process to obtain the desired symmetry of the ribs on the cymbal such as by stamping; however, the ribs could be formed manually or by another process. The depth and width of the ribs is selected to provide the desired sound, tonal, rigidity and strength qualities for the cymbal.

Figure 2:
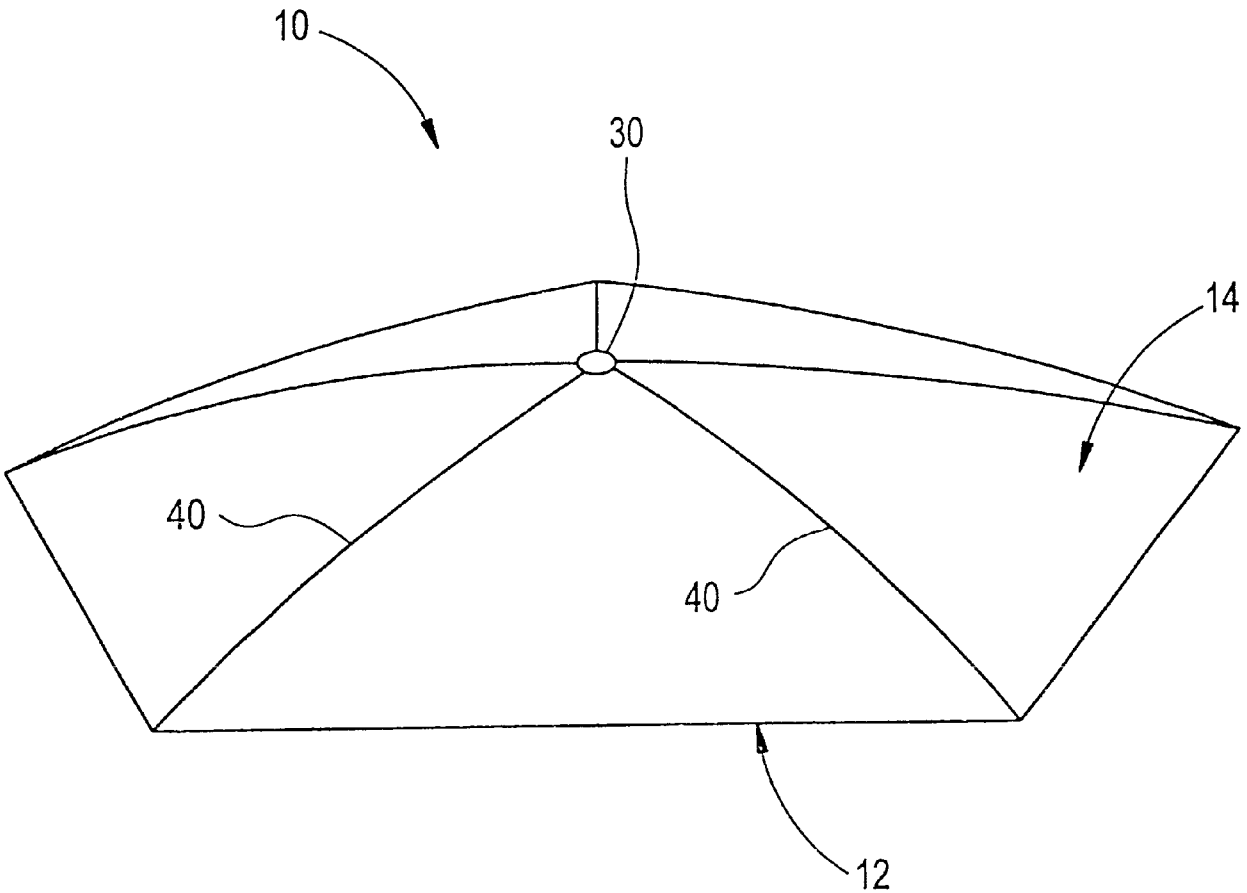
FIG. 2 is a top elevation view of another embodiment of the cymbal having a plurality of ribs wherein some ribs are spaced from the center and other ribs extend to the center of the cymbal and some ribs extend to the edge of the cymbal and some ribs are spaced from the edge of the cymbal in accordance with the present invention.

Referring now to FIGS. 2–5, additional embodiments of the invention are illustrated. In FIG. 2, cymbal 10 is a polygon shaped cymbal that includes a plurality of ribs 40 on the top surface 14 of the cymbal. The cymbal includes an opening 30. At least one rib is shown to extend to opening 30. At least one rib is shown to be space from opening 30. At least one rib is shown to extend to peripheral edge 12 of the cymbal. At least one rib is shown to be spaced from the peripheral edge 12 of the cymbal.

Figure 3:
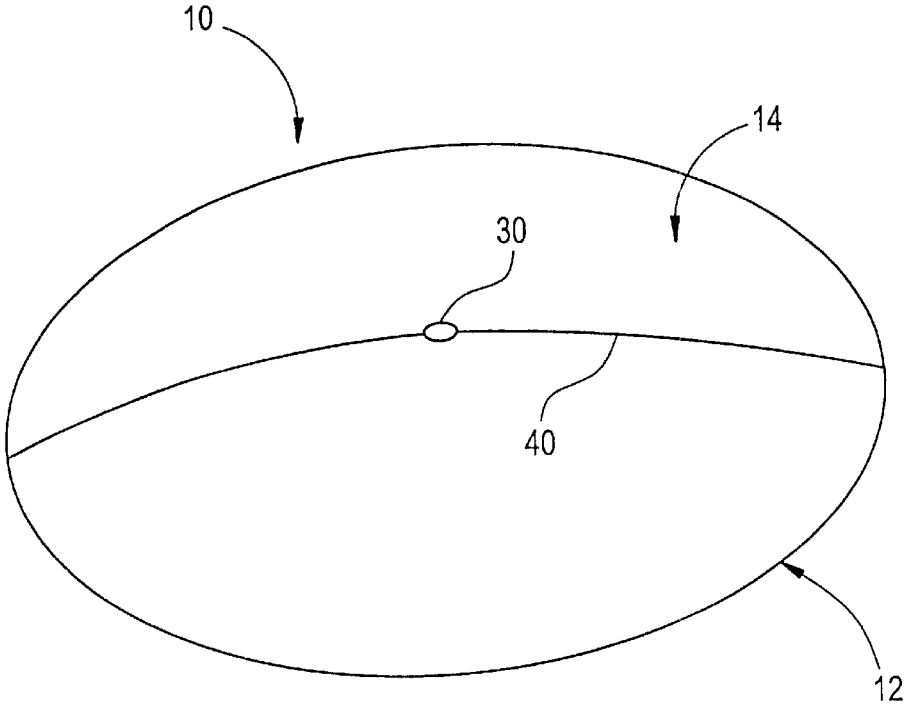
FIG. 3 is a top elevation view of another embodiment of the cymbal having a circular shape and a plurality of ribs in accordance with the present invention.

In FIG. 3, cymbal 10 is a circular shaped cymbal that includes a plurality of ribs 40 on the top surface 14 of the cymbal. The cymbal includes an opening 30. The ribs 40 are shown to extend to opening 30 and to peripheral edge 12 of the cymbal.

Figure 4:
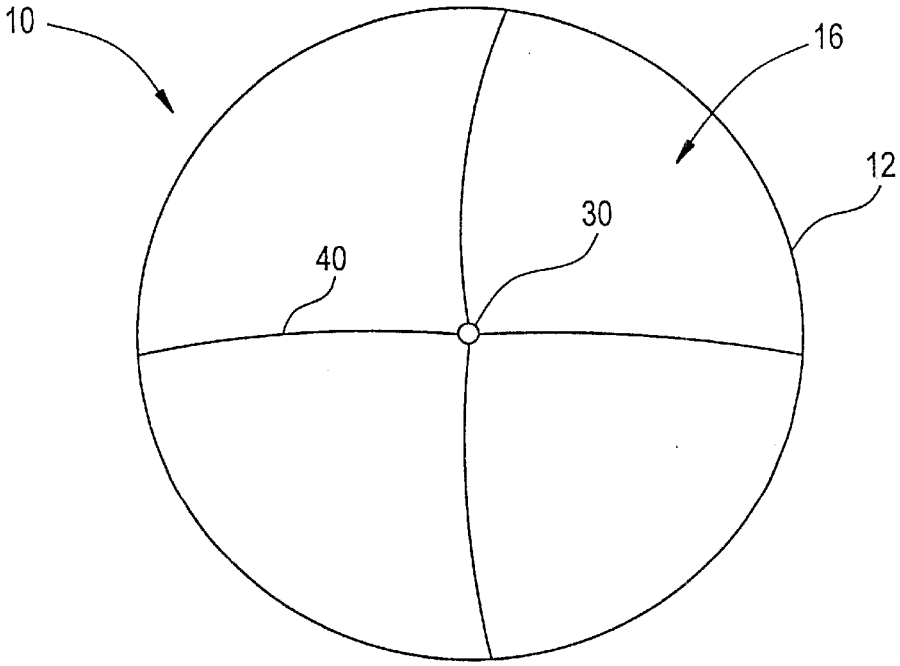
FIG. 4 is a bottom view of another embodiment of the cymbal having a circular shape and a plurality of ribs on the bottom side of the cymbal in accordance with the present invention.

In FIG. 4, cymbal 10 is a circular shaped cymbal that includes a plurality of ribs 40 on the bottom surface 14 of the cymbal. The cymbal includes an opening 30. At least one rib is shown to extend to opening 30. At least one rib is shown to be space from opening 30. At least one rib is shown to extend to peripheral edge 12 of the cymbal. At least one rib is shown to be spaced from the peripheral edge 12 of the cymbal.

Figure 5:
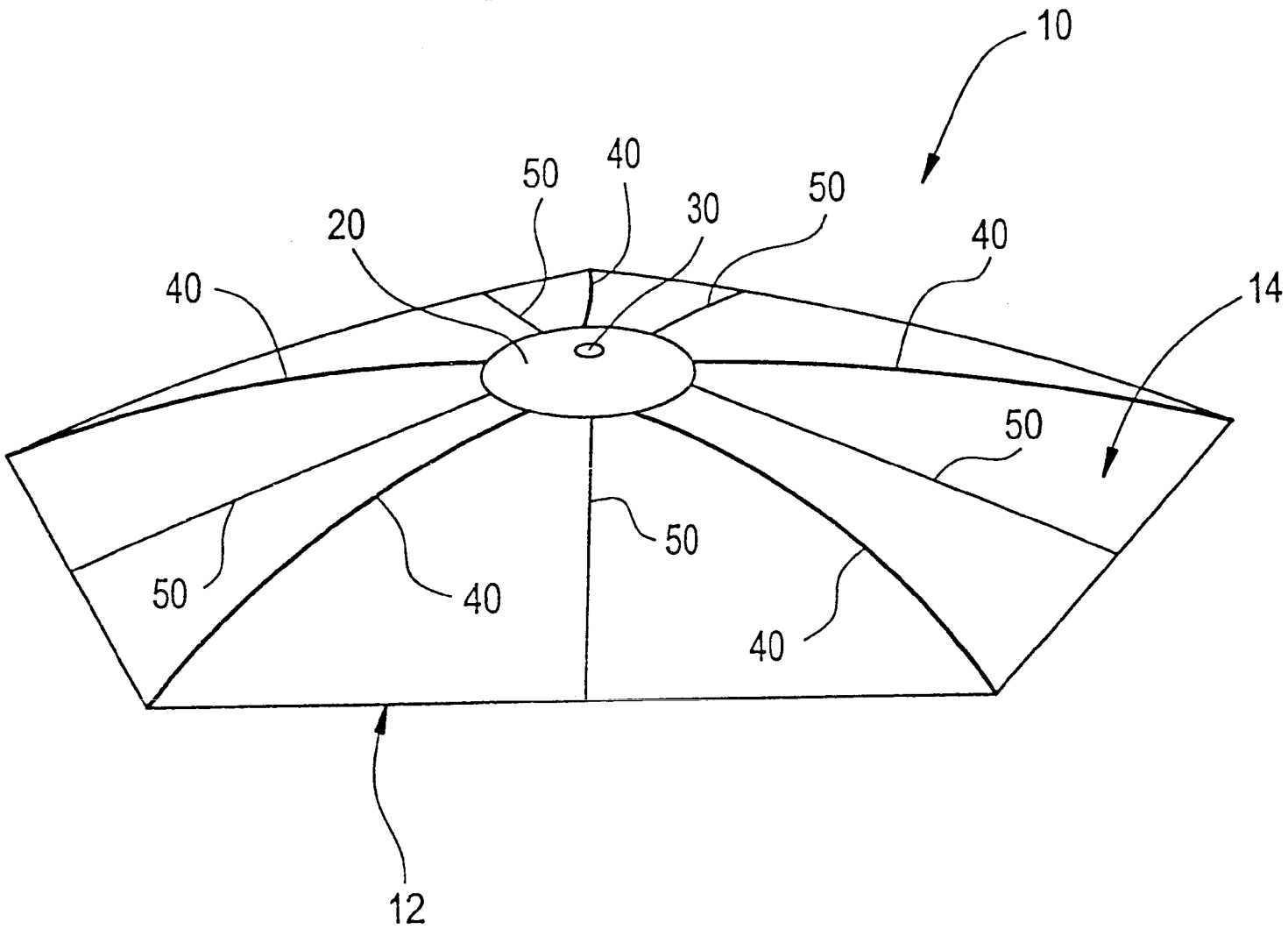
FIG. 5 is a top elevation view of another embodiment of the cymbal having a plurality of ribs and a plurality of tonal grooves in accordance with the present invention.

In FIG. 5, cymbal 10 is a polygon shaped cymbal that includes a plurality of ribs 40 and a plurality of tonal grooves 50 on the top surface 14 of the cymbal. The cymbal includes a circular bell 30 that includes an opening 30. The ribs 40 are shown to extend from bell 20 peripheral edge 12 of the cymbal. The tonal grooves 50 are shown to extend from bell 20 peripheral edge 12 of the cymbal. The tonal grooves are illustrated as being linear or straight shaped; however, other shapes of tonal grooves can be use. The cymbal may include other tonal modifiers such as pits, coatings, chemical treatments and the like.

In summary, the present invention specifically pertains to the unique placement of ribs on a cymbal to produce a louder and richer sounding cymbal that has increased resistance to damage during play. The ribs are positioned on the cymbal so that the ribs are substantially linear in shape and preferably extend from the bell of the cymbal and radiate outwardly toward the edge of the cymbal.

The invention has been described with reference to preferred embodiments and alternates thereof. It is believed that many modifications and alterations to the embodiments disclosed will readily suggest themselves to those skilled in the art upon reading and understanding the description of the invention and drawings of the invention. It is intended to include all such modifications and alterations insofar as they come within scope of the present invention.

I claim:

1. A cymbal comprising a plate which includes structural ribs, which ribs are substantially linear in shape.

2. A cymbal as defined in claim 1, wherein said plate has a shaped selected from the group consisting of an ellipse or polygon.

3. A cymbal as defined in claim 1, wherein the ribs are positioned on the top surface of the cymbal.

4. A cymbal as defined in claim 2, wherein the ribs are positioned on the top surface of the cymbal.

5. A cymbal as defined in claim 1, wherein the ribs are positioned on the bottom surface of the cymbal.

6. A cymbal as defined in claim 4, wherein the ribs are positioned on the bottom surface of the cymbal.

7. A cymbal as defined in claim 1, wherein at least one rib extends substantially from the center of the cymbal.

8. A cymbal as defined in claim 3, wherein at least one rib extends substantially from the center of the cymbal.

9. A cymbal as defined in claim 5, wherein at least one rib extends substantially from the center of the cymbal.

10. A cymbal as defined in claim 6, wherein at least one rib extends substantially from the center of the cymbal.

11. A cymbal as defined in claim 1, wherein at least one rib extends from a point spaced from the center of the cymbal.

12. A cymbal as defined in claim 3, wherein at least one rib extends from a point spaced from the center of the cymbal.

13. A cymbal as defined in claim 5, wherein at least one rib extends from a point spaced from the center of the cymbal.

14. A cymbal as defined in claim 6, wherein at least one rib extends from a point spaced from the center of the cymbal.

15. A cymbal as defined in claim 10, wherein at least one rib extends from a point spaced from the center of the cymbal.

16. A cymbal as defined in claim 1, wherein at least one rib extends substantially to the edge of the cymbal.

17. A cymbal as defined in claim 10, wherein at least one rib extends substantially to the edge of the cymbal.

18. A cymbal as defined in claim 15, wherein at least one rib extends substantially to the edge of the cymbal.

19. A cymbal as defined in claim 1, wherein at least one rib extends to a point which is spaced from the edge of the cymbal.

20. A cymbal as defined in claim 10, wherein at least one rib extends to a point which is spaced from the edge of the cymbal.

21. A cymbal as defined in claim 14, wherein at least one rib extends to a point which is spaced from the edge of the cymbal.

22. A cymbal as defined in claim 15, wherein at least one rib extends to a point which is spaced from the edge of the cymbal.

23. A cymbal as defined in claim 1, wherein at least two ribs are substantially uniformly spaced from one another.

24. A cymbal as defined in claim 1, wherein at least two ribs have a varying space relationship to one another as compared to the other ribs on the cymbal.

25. A cymbal as defined in claim 1, wherein at least one rib has a height, which height is substantially uniform throughout the length of the rib.

26. A cymbal as defined in claim 1, wherein at least one rib has a height that at least partially varies along the length of the rib.

27. A cymbal as defined in claim 1, wherein at least two ribs are substantially symmetrically oriented on said cymbal.

28. A cymbal as defined in claim 17, wherein at least two ribs are substantially symmetrically oriented on said cymbal.

29. A cymbal as defined in claim 21, wherein at least two ribs are symmetrically oriented on said cymbal.

30. A cymbal as defined in claim 23, wherein at least two ribs are symmetrically oriented on said cymbal.

31. A cymbal as defined in claim 1, wherein at least one rib has a width that is substantially uniforms along the length of the tonal groove.

32. A cymbal as defined in claim 1, wherein at least one rib has a width that varies along the length of the rib.

33. A cymbal as defined in claim 1, wherein at least two ribs have substantially the same length.

34. A cymbal comprising a plate which includes structural ribs, which ribs are substantially linear in shape, including at least one tonal modifier, said tonal modifier selected from the group consisting of a pit, a circular tonal groove, a score line, a coating and combinations thereof.

35. A cymbal comprising a plate which includes structural ribs, which ribs are substantially linear in shape, wherein the thickness of the plate varies.

36. A cymbal comprising a plate which includes at least one structural rib, said structural rib being substantially linear in shape, said plate having a substantially pentagonal shape.

37. A cymbal as defined in claim 36, wherein said at least one structural rib being positioned on the top surface of the cymbal.

38. A cymbal as defined in claim 36, wherein said at least one structural rib being positioned on the bottom surface of the cymbal.

39. A cymbal as defined in claim 37, wherein said at least one structural rib being positioned on the bottom surface of the cymbal.

40. A cymbal as defined in claim 36, wherein said at least one structural rib extends to a point at least closely adjacent to the center of the cymbal.

41. A cymbal as defined in claim 40, wherein said at least one structural rib extends to the center of the cymbal.

42. A cymbal as defined in claim 36, wherein said at least one structural rib extends to a point closely adjacent to the edge of the cymbal.

43. A cymbal as defined in claim 42, wherein said at least one structural rib extends to the edge of the cymbal.

44. A cymbal as defined in claim 36, wherein at least two of said structural ribs are substantially uniformly spaced from one another.

45. A cymbal as defined in claim 36, wherein at least two of said structural ribs have a varying space relationship to one another as compared to the other ribs on the cymbal.

46. A cymbal as defined in claim 36, wherein said at least one structural rib has a height, which height is substantially uniform throughout the length of the rib.

47. A cymbal as defined in claim 36, wherein said at least one structural rib has a height that at least partially varies along the length of the rib.

48. A cymbal as defined in claim 36, wherein said at least one structural rib has a width that is substantially uniform along the length of the tonal groove.

49. A cymbal as defined in claim 36, wherein said at least one structural rib has a width that varies along the length of the rib.

50. A cymbal as defined in claim 36, wherein at least two of said structural ribs have substantially the same length.

51. A cymbal comprising a plate which includes at least one structural rib, said structural rib being substantially linear in shape, said plate having a substantially pentagonal shape, including at least one tonal modifier, said tonal modifier selected from the group consisting of a pit, a circular tonal groove, a score line, a coating and combinations thereof.

52. A cymbal comprising a plate which includes at least one structural rib, said structural rib being substantially linear in shape, said plate having a substantially pentagonal shape, wherein the thickness of the plate varies.

* * * * *